US005470062A

United States Patent [19]

Takatsuka

[11] Patent Number: 5,470,062

[45] Date of Patent: Nov. 28, 1995

[54] TENNIS RACKET

[75] Inventor: Masanori Takatsuka, Shizuoka, Japan

[73] Assignee: Yamaha Corporation, Japan

[21] Appl. No.: 352,600

[22] Filed: Dec. 9, 1994

[30] Foreign Application Priority Data

Dec. 10, 1993 [JP] Japan ..... 5-340932

[51] Int. Cl.[6] ..... A63B 49/04

[52] U.S. Cl. ..... 273/73 R; 273/73 C

[58] Field of Search ..... 273/73 R, 73 C, 273/73 G

[56] References Cited

U.S. PATENT DOCUMENTS

| | | | |
|---|---|---|---|
| 3,801,099 | 4/1974 | Lair | 273/73 C |
| 3,913,911 | 10/1975 | Peterson | 273/73 C |
| 4,027,881 | 6/1977 | Hefenus . | |
| 4,153,249 | 5/1979 | Plagenhoef | 273/73 C |
| 4,182,512 | 1/1980 | Kuebler | 273/73 C |
| 4,192,505 | 3/1980 | Tabickman | 273/73 C |
| 4,196,901 | 4/1980 | Durbin | 273/73 G |
| 4,353,551 | 10/1982 | Arieh et al. | 273/73 C |
| 4,693,474 | 9/1987 | Glaessgen et al. . | |
| 5,054,780 | 10/1991 | Chen | 273/73 C X |
| 5,083,777 | 1/1992 | Held | 273/73 C X |
| 5,110,126 | 5/1992 | Knebler | 273/73 C |

FOREIGN PATENT DOCUMENTS

| | | | |
|---|---|---|---|
| 2088220 | 6/1982 | United Kingdom | 273/73 C |

*Primary Examiner*—William E. Stoll

*Attorney, Agent, or Firm*—Ostrolenk, Faber, Gerb & Soffen

[57] ABSTRACT

In construction of a tennis racket having a frame top and a yoke, balance adjusters having specific gravities larger than that of a frame are arranged at the frame top and the yoke, respectively, with a specified mass ratio between the two balance adjusters. Repulsion characteristics are much improved and vibratory impact is mitigated even at off-spot shooting whilst assuring long and speedy fly of balls with reduced physical damages on players.

9 Claims, 4 Drawing Sheets

TENNIS RACKET

BACKGROUND OF THE INVENTION

The present invention relates to a tennis racket, and more particularly relates to improvement in dynamic behaviour of a light weight tennis racket suited for use by unskilled players, in particular at off-spot shooting.

Here, the term "off-spot shooting" refers to shooting at face sections outside the sweet spot of a tennis racket.

It is already proposed to arrange a heavy mass at a section of a head corresponding to the largest width of the face of a tennis racket for higher plane stability in the case of off-spot shooting, and the mass is usually made of a material having a specific gravity larger than that of a frame of the tennis racket. For example, such a mass is made of lead or the like.

It is also proposed to arrange a heavy mass, which is made of a material of a large specific gravity such as lead, at the frame top of a tennis racket. Presence of such a heavy mass at the frame top increases the moment of inertia of area of the tennis racket and brings the center of mass near the center of the face of the tennis racket. Increased moment of inertia of area and displaced center of mass concur to assure good flight of balls even in the case of off-spot shooting.

Despite such optimization of moment of inertia and center of mass, no appreciable improvements have been attained in relation to repulsion characteristics and vibratory impact at off-spot shooting. As a result, lowering in repulsion characteristics causes low speed flight of balls and high vibratory impact tends to impose physical damages such as tennis elbow in particular on unskilled players, both in case of off-spot shooting.

In addition, presence of a heavy mass at the frame top inevitably causes undesirable displacement of the sweet spot towards the frame top. Normally, a sweet spot of a tennis racket is designed to be situated around the center area of its face. So, such displacement of the sweet spot towards the frame top reduces the effective surface area of the sweet spot because of the substantially oval shape of the face. Knowledge of this results imposes a sort of mental stress on unskilled players and makes them feel it difficult to manipulate the tennis racket as they intend.

SUMMARY OF THE INVENTION

It is the primary object of the present invention to provide a light weight tennis racket of an improved dynamic behaviour at off-spot shooting in particular suited for unskilled players.

It is another object of the present invention to maintain high repulsion characteristics at off-spot shooting, thereby assuring high speed flight of balls.

It is the other object of the present invention to mitigate vibratory impact even at off-spot shooting, thereby releasing unskilled players from the troubles of physical damages such as tennis elbow.

It is a further object of the present invention to provide a tennis racket which can be easily manipulated even by unskilled players.

In accordance with the basic aspect of -the present invention, a substantially oval frame has a frame top and a yoke, the first balance adjuster is arranged at the frame top and made of the first material having the first specific gravity larger than that of the frame, the second balance adjuster is arranged at the yoke and made of the second material having the second specific gravity larger than that of the frame, the mass of the second balance adjuster is 1.5 to 2.9 times larger than that of the first balance adjuster.

In one preferred embodiment of the present invention, the total mass of the tennis racket is in a range from 220 to 350 g.

In another preferred embodiment of the present invention, the first material for the first balance adjuster is same as the second material for the second balance adjuster.

In the other preferred embodiment of the present invention, the first material for the first balance adjuster is different from the second material for the second balance adjuster but the first specific gravity of the first material is same as the second specific gravity of the second material.

In the other preferred embodiment of the present invention, the first material for the first balance adjuster is different from the second material for the second balance adjuster and the first specific gravity of the first material is different from the second specific gravity of the second material.

In a further preferred embodiment of the present invention the first balance adjuster extends over a distance of 10% or less of the total racket length, i.e. the straight length of the racket along its longitudinal center axis, from the frame top end and the second balance adjuster extends over a distance of 10% or less of the total racket length from the yoke end.

DESCRIPTION OF THE PREFERRED EMBODIMENTS

Figure 1:
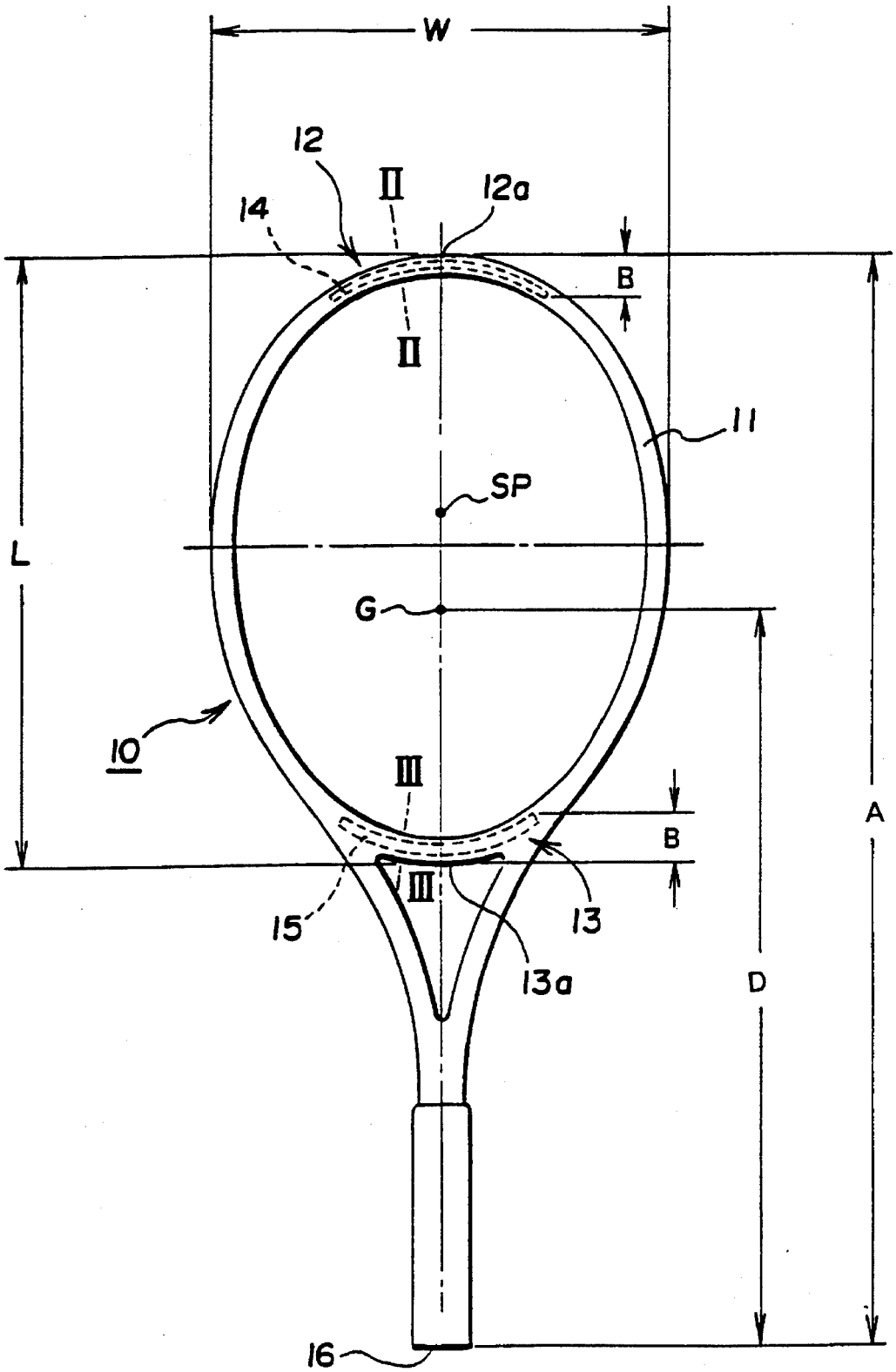
FIG. 1 is a top view of one embodiment of the tennis racket in accordance with the present invention.
Figure 2:
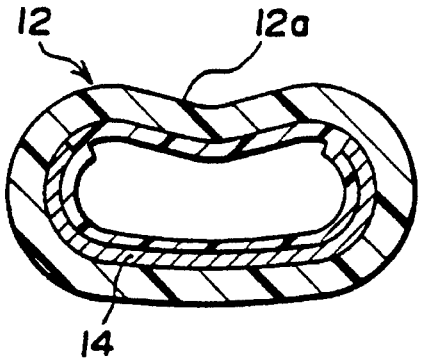
FIG. 2 is a transverse sectional view taken along a line II—II in FIG. 1.
Figure 3:
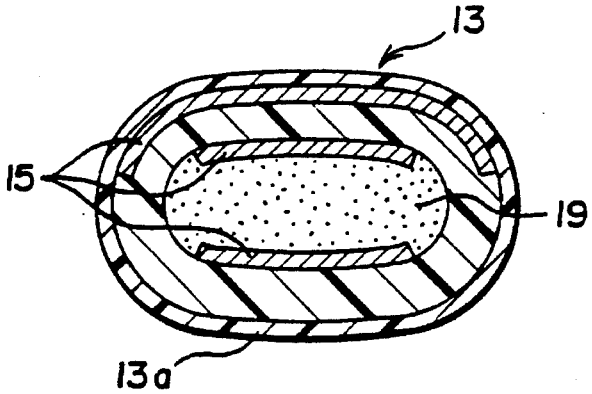
FIG. 3 is a transverse sectional view taken along a line III—III in FIG. 1.

One embodiment of the tennis racket in accordance with the present invention is shown in FIG. 1, in which a tennis racket 10 has total racket length A of 680 mm. The tennis racket 10 includes an oval head of a longitudinal diameter L equal to 360 mm and a lateral diameter W equal to 280 mm. The head has tubular constructions at least at a frame top 12 and a yoke 13 in order to accommodate first and second balance adjusters 14, 15 as shown in FIGS. 2 and 3.

The balance adjusters 4 and 5 are made of materials having a specific gravity or specific gravities by far larger than that of the frame. For example, the balance adjusters 14 and 15 are made of lead when the frame is made of carbon fibers. Glass fiber reinforced plastic can also be used for the balance adjusters. The balance adjusters 14 and 15 may be made either same or different materials. When the balance adjusters 14 and 15 are made of different materials, these materials may have either or different specific gravities.

The balance adjusters 14 and 15 are preferably given in the form of straps. In the case of the construction shown in FIG. 2, only one strap type balance adjuster 14 is accommodated in the frame top 12 whilst leaving the original tubular construction. Whereas in the case of the construction shown in FIG. 3, two strap type balance adjusters 15 are accommodated in the yoke 13 sandwiching a foamed polyurethane filler 19.

Though not illustrated in FIG. 1, an additional balance adjuster of 36 g made of lead is preferably inserted into a grip within an area of 100 mm from a grip end 16 in order to adjust the position of the center of mass of the tennis racket 10.

In one typical example, a balance adjuster 14 of 15 g is inserted into the frame top 12 whilst extending toward the yoke 13 over a distance B of 30 mm, which corresponds to about 4.4% of the total racket length (680 mm), from the frame top end 12*a*. A balance adjuster 15 of 33 g is inserted into the yoke 13 whilst extending towards the frame top 12 over a distance B of 30 mm, which corresponds to about 4.4% of the total racket length, from the yoke end 13*a*.

The logical basis for supporting the concept of the present invention will now be described in detail in reference to FIGS. 5 to 6C.

As stated above, it is the basic object of the present invention to enable rise in repulsion characteristics with optimal positioning of the sweet spot of a tennis racket.

In order to correctly elucidate the problems of repulsion characteristics and vibratory impact of a tennis racket at shooting balls, it is necessary to introduce the concept of vibration beyond the classical theory of rigidity. From this point of view, it is intended by the present invention to optimize participation of mass distribution in vibration characteristics in terms of the primary vibration mode in order to improve repulsion characteristics and to mitigate vibratory impact.

Figure 5:
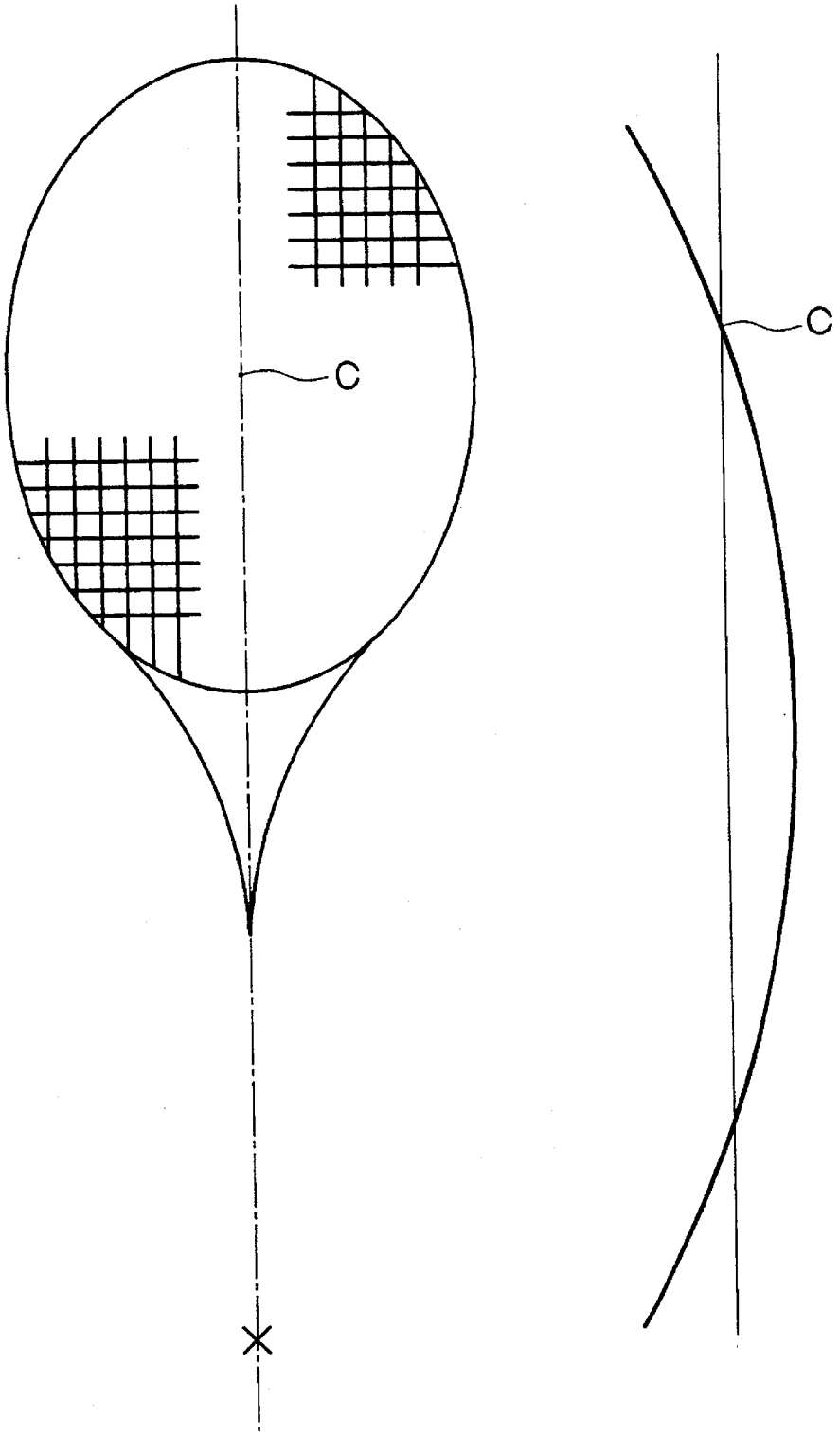
FIG. 5 is an explanatory view for showing the mode of the primary vibration of a tennis racket at shooting balls.

The relationship between the amplitude of the primary vibration and the spot of shooting is shown in FIG. 5, in which the center of the sweet spot falls on the center C of the face of a tennis racket. It is clearly observed in the illustration that the amplitude is almost equal to zero at the sweet spot center and increases gradually as the spot of shooting leaves from the sweet spot center. Roughly speaking, the node of the primary vibration falls on the sweet spot center and the antinode falls on the frame top and yoke of the tennis racket.

It is well understood that the larger the total mass of the head of a tennis racket, the higher the repulsion speed of a ball shot by such a tennis racket. Stated otherwise, the larger the total mass of a tennis racket, the better the repulsion characteristics. Despite such improvement in repulsion characteristics, too large mass of a tennis racket disenables good control on swing motion by a player. For these reasons, it is highly necessary to specify an optimal mass distribution within a given limit of the total mass which enables rise in repulsion characteristics and mitigation of vibratory impact.

The magnitude of influence of a local mass on the primary vibration mode varies depending on the location of that local mass. Such a magnitude of influence will hereinafter referred to as "percent mass participation." The mode of the primary vibration is given in the form of the kinetic energy of such a vibration as follows;

$$E=\tfrac{1}{2}\Sigma V_k^2 \cdot m_k \qquad (1)$$

$V_k$: velocity at a location k $m_k$: local mass at the location k

A part of this formula, i.e. ½ $V_k^2$ represents the percent mass participation.

In order to realize improvement in repulsion characteristics and mitigation of vibratory impact by effectively utilizing the total mass of a limited value, it is first reduce the mass of unrelated locations as much as the rigidity and strength requirement allows, and to next allocate collectively the excessive mass so obtained to the frame top and the yoke of a tennis racket where the percent mass participation is highest.

Next, mass allocation ratio must be fixed in consideration of optimal positioning of the sweet spot.

Figure 6A:
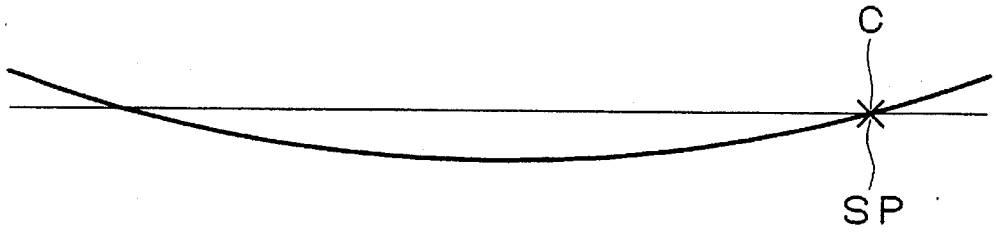
FIGS. 6A to 6C are graphic views for showing the relationship between the mode of the primary vibration and the type of the mass distribution of a tennis racket.

FIG. 6A shows the mode of the primary vibration when the tennis racket has the conventional mass allocation. Here, the sweet spot center SP falls substantially on the face center C.

Figure 6B:
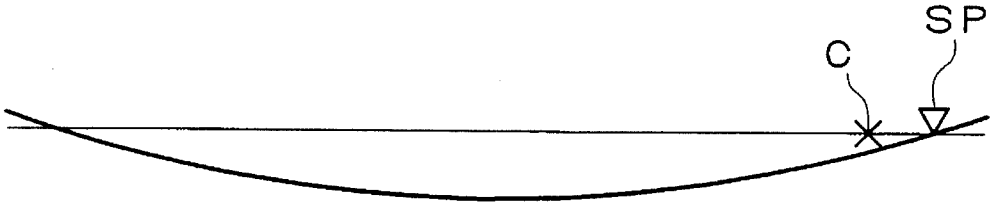

FIG. 6B shows the mode of the primary vibration when the excessive mass is collectively allocated near the frame top. Here, the sweet spot center SP is displaced towards the frame top. As a consequence, the repulsion characteristics and the vibratory impact are improved on the frame top side but rather aggravated on the york side when compared with those in the FIG. 6A situation.

Figure 6C:
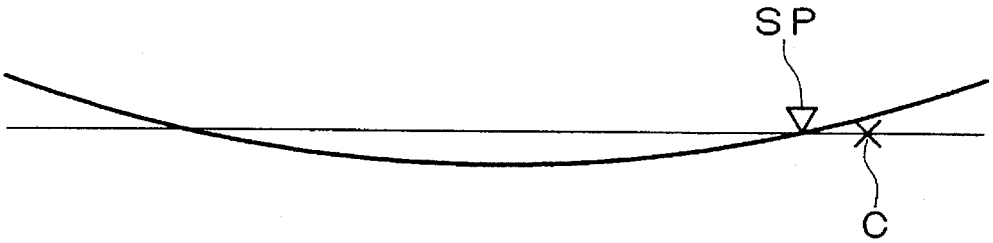

FIG. 6C shows the mode of the primary vibration when the excessive mass is collectively allocated near the yoke. Here, the sweet spot center SP is displaced towards the yoke. As a consequence, the repulsion characteristics and the vibratory impact are improved on the yoke side but rather aggravated on the frame top side when compared with those in the FIG. 6A situation.

From the foregoing, it will be well understood that allocation of the excessive mass has to be done with a mass allocation ratio of a limited range while take optimal positioning up the sweet spot into consideration too.

It was already confirmed by the inventor through a series of simulation tests that a high degree of cotelation exists between the yoke/frame top mass allocation ratio and the position of the sweet spot and the cotelation is given by the following formula when the sweet spot spons the area of 150 to 190 mm from the frame top;

$$R=m_y/m_f=2.2\pm0.7 \qquad (2)$$

R; mass allocation ratio $m_y$; mass of the yoke $m_f$; mass of the frame top

It was also confirmed that the sweet spot is displaced towards the frame top when the mass allocation ratio (R) falls short of the lower limit (1.5). Whereas, the sweet spot is displaced toward the yoke when the mass allocation ratio (R) exceeds the upper limit (2.9). From this analysis, it is clear that the yoke/frame top mass allocation ratio should be in a range from 1.5 to 2.9 in order to keep the sweet spot at the optimal, central position in the face of the tennis racket.

The concrete examples for the tennis rackets shown in FIGS. A6 to 6C are as follows;

FIG. 6A (Conventional)
$m_y$=219 g
$m_f$=91 g
R=2.41

FIG. 6B (Mass allocation on the frame top only)
$m_y$=164 g
$m_f$=156 g
R=1.05

FIG. 6C (Mass allocation on the yoke only)
$m_y$=303 g
$m_f$=69 g
R=4.39

It is clear from these data that the mass allocation ratios for the FIGS. 6B and 6C situations fall outside the above-described preferable range.

From the view point of rigidity and strength requirements, the acceptable, minimum total mass of a tennis racket is about 220 g, and more preferably 260 g. Whereas, from the viewpoint of physical load on average players, the acceptable, maximum total mass of a tennis racket is about 350 g, and more preferably 310 g. So for utmost safely in both viewpoints, a total mass in a range from 260 to 310 g is acceptable. Thus, the difference of about 50 g can be used for mass allocation.

EXAMPLES

For measurement of dynamic behaviours, a tennis racket sample of the above-described construction was subjected to various tests. The net total mass of the tennis racket was 327 g and the total mass of the tennis racket with strings in its face was 342 g. As shown in FIG. 1, the distance D between the grip end 16 and the center of mass G was 318 mm. The sweet spot SP of this tennis racket was displaced by 20 mm from the center of the head 11 towards the frame top end 12*a*.

For comparison purposes, a solid type conventional tennis racket with foamed urethane filler was prepared. The total mass and the position of the center of mass of this conventional sample were designed same as those of the sample of the present invention.

Figure 4:
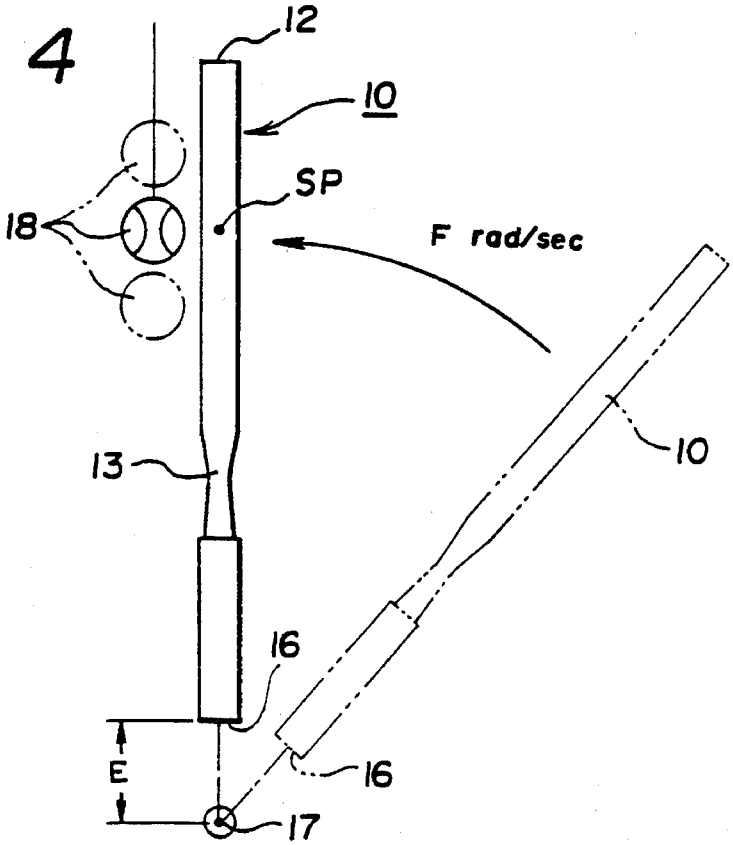
FIG. 4 is a side view for showing operation of the tennis racket shown in FIG. 1.

Each sample was set to an automatic batting machine so as to swing about a center of rotation 17 which was located at a position E of 120 mm from its grip end 16. A stationary tennis ball 18 was shot by the swinging sample at an angular velocity F of 33.7 rad/sec as shown in FIG. 4 and the resultant speed of the flying tennis ball 18 was measured.

Three shooting spots were chosen on the face of each sample. The first shooting spot fell on the sweet spot SP, the second shooting spot fell on a location of 65 mm displaced from the sweet spot SP towards the frame top end 12*a*, and the third shooting spot fell on a location of 65 mm displaced from the sweet spot SP towards the grip end 16. The results of measurement are given in Table 1 in which ball speeds are indicated in the form of ratios with respect to the ball speed when shot at the first shooting spot, i.e. at the sweet spot SP.

The data given in the table fairly endorse the fact that the tennis racket in accordance with the present invention is clearly excellent in repulsion characteristics, in particular in the ease of off spot shooting.

Further, for measurement of impact on the body of players at shooting balls, each sample was hung upside down via an extensible rubber string attached to its grip end 16 and subjected to an impact of the unit impulse ($10^{-3}$N.S). The resultant maximum displacement and maximum acceleration were measured by impulse response system. Shooting force was detected by load cells and response was detected by an acceleration meter. The results of measurement are given in Tables 2 and 3.

TABLE 1

| Shooting spot | Sample of the invention | Conventional sample |
|---|---|---|
| First spot | 1.00 | 1.00 |
| Second spot | 0.98 | 0.93 |
| Third spot | 0.82 | 0.78 |

TABLE 2

| | Maximum displacement ($m \cdot N^{-1}$) | |
|---|---|---|
| Shooting spot | Sample of the invention | Conventional sample |
| Second spot | $3.019 \times 10^{-3}$ | $3.194 \times 10^{-3}$ |
| Third spot | $2.537 \times 10^{-3}$ | $2.660 \times 10^{-3}$ |

TABLE 3

| | Maximum acceleration ($m \cdot S^{-2} \cdot N^{-1}$) | |
|---|---|---|
| Shooting spot | Sample of the invention | Conventional sample |
| Second spot | $1.689 \times 10^{3}$ | $2.044 \times 10^{3}$ |
| Third spot | $1.419 \times 10^{3}$ | $1.702 \times 10^{3}$ |

It is fairly shown in the tables that the maximum displacement and the maximum acceleration in the ease of the sample of the present invention are both clearly smaller than those in the ease of the conventional sample even when off-spot shooting is committed. Stated otherwise, reduced physical damage is imposed on players.

It is clear from the foregoing that significant improvements in dynamic behaviour of a tennis racket at off-spot shooting can be expected when balance adjusters are arranged in accordance with the concept of the present invention. In addition, the sweet spot is located around the center of the face as in the case of the conventional tennis racket. Thus, comfortable feel in use much removes mental stress on unskilled players. Reduced vibratory impact at ball shooting well mitigates physical damage on players.

I claim:

1. A tennis racket comprising a substantially oval frame including a frame top and a yoke, a first balance adjuster arranged at said frame top and made of a first material having a first specific gravity larger than that of said frame, and a second balance adjuster arranged at said yoke and made of a second material having a second specific gravity larger than that of said frame, the mass of said second balance adjuster being 1.5 to 2.9 times larger than that of said first balance adjuster.

2. A tennis racket as claimed in claim 1 in which a total mass of said tennis racket is in a range from 220 to 350.

3. A tennis racket as claimed in claim 1 in which said first material for said first balance adjuster is same as said second material for said second balance adjuster.

4. A tennis racket as claimed in claim 3 in which said first specific gravity of said first material is same as said second specific gravity of said second material.

5. A tennis racket as claimed in claim 3 in which said first specific gravity of said first material is different from said second specific gravity of said second material.

6. A tennis racket as claimed in claim 5 in which said second balance adjuster extends over a distance of 10% or less of the total racket length from a yoke end.

7. A tennis racket as claimed in claim 1 in which said first material for said first balance adjuster is different from said second material for said second balance adjuster.

8. A tennis racket as claimed in claim 1 in which said first balance adjuster extends over a distance of 10% or less of the total racket length from a frame top end.

9. A tennis racket as claimed in claim 1 in which said second balance adjuster extends over a distance of 10% or less of the total racket length from a yoke end.

* * * * *